United States Patent [19]

Shelley

[11] 4,399,782

[45] Aug. 23, 1983

[54] DEVICE FOR STARTING INTERNAL COMBUSTION ENGINES

[76] Inventor: Jack W. Shelley, Rte. 2, Headland, Ala. 36345

[21] Appl. No.: 303,967

[22] Filed: Sep. 21, 1981

[51] Int. Cl.[3] ..... F02N 11/12

[52] U.S. Cl. ..... 123/179 SE; 74/6

[58] Field of Search ..... 123/179 SE, 185 P; 464/59, 57; 74/6

[56] References Cited

U.S. PATENT DOCUMENTS

| | | | |
|---|---|---|---|
| 1,116,370 | 11/1914 | Bendix | 464/59 |
| 1,203,528 | 10/1916 | Gardner | 74/6 |
| 1,360,867 | 11/1920 | Bearens | 464/59 |
| 3,596,647 | 8/1971 | Heisler | 123/179 SE |
| 3,885,544 | 5/1975 | Pfeiffer | 123/179 SE |

*Primary Examiner*—Charles J. Myhre
*Assistant Examiner*—Andrew M. Dolinar
*Attorney, Agent, or Firm*—Woodford R. Thompson, Jr.

[57] ABSTRACT

A device for transmitting power from a power driving unit to a driven member of an internal combustion engine embodies a first power transmitting member having one end adapted to be detachably connected to the power driving unit. A second power transmitting member in axial alignment with the first power transmitting member has one end adapted to be detachably connected to the driven member of the internal combustion engine. Cooperating male and female threaded members are carried by adjacent end portions of the first and second power transmitting members. Upon rotation of the cooperating members in one direction, the adjacent end portions of the power transmitting members move toward each other and engage each other to transmit power from the power driving unit to the driven member of the internal combustion engine. A resilient member operatively connects the power transmitting members to each other and absorbs shock and kick-back forces generated by the driven member of the internal combustion engine.

1 Claim, 5 Drawing Figures

DEVICE FOR STARTING INTERNAL COMBUSTION ENGINES

BACKGROUND OF THE INVENTION

This invention relates to a device for transmitting power from a power driving unit to a driven member and more particularly to such a device which is adapted to transmit power from a power driving unit, such as an electric drill, to a driven member of an internal combustion engine, such as an engine for a lawnmower, garden tractor, go-cart, water pumps and the like.

As is well known in the art to which my invention relates, as lawnmower engines become worn or their ignition system becomes weak, starting the engine with the usual hand pull mechanism becomes a difficult and tiresome task. People who are physically impaired or who no longer have the strength to use the hand pull mechanism usually must use a mower which has an automatic or an electrically operated starting system. Such lawnmowers are not only expensive but they require considerable maintenance to assure that they operate properly.

SUMMARY OF THE INVENTION

In accordance with my invention, I overcome the above and other difficulties by providing a device for transmitting power from a power driving unit to a driven member of an internal combustion engine which is simple of construction and economical of manufacture. My improved device provides means for quickly and easily starting the small gasoline engine of a lawnmower by a person who is physically impaired or who no longer has the strength to pull the usual hand pull starting mechanism. Also, my improved device absorbs any shock or kick-back forces generated by the engine which would damage the power driving unit.

My improved device for transmitting power from a power driving unit to a driven member of an internal combustion engine embodies a first shaft-like power transmitting member with one end thereof adapted to be detachably connected to a power driving unit. A second shaft-like power transmitting member is in axial alignment with the first power transmitting member with one end thereof adapted to be detachably connected to a driven member of an internal combustion engine. A threaded connection is provided between adjacent end portions of the axially aligned power transmitting members whereby upon rotation of the power transmitting members relative to each other in one direction, the adjacent end portions move toward each other and engage each other to transfer power from the driving member to the driven member. A resilient member operatively connects the first and second power transmitting members to each other and absorbs any shock or kick-back loads from the driven member of the internal combustion engine which would damage the power driving unit.

BRIEF DESCRIPTION OF THE DRAWING

Apparatus embodying features of my invention is illustrated in the accompanying drawing, forming a part of this application, in which.

DETAILED DESCRIPTION

Figure 5:
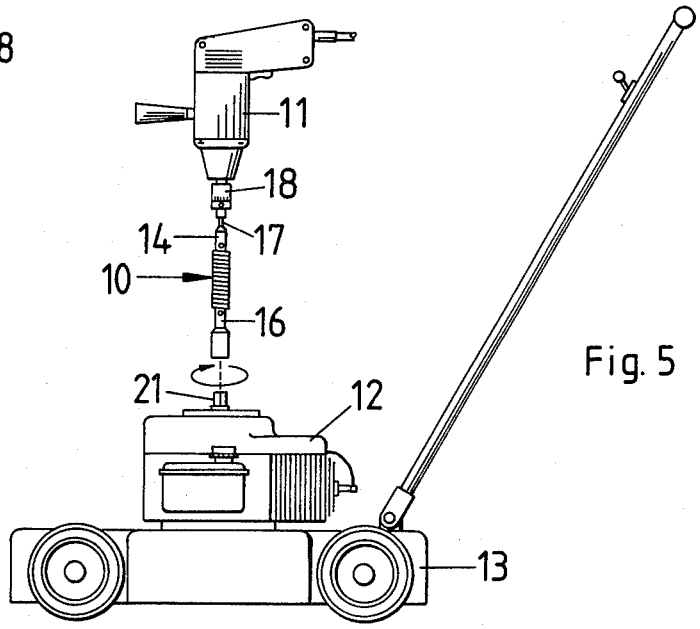

Referring now to the drawing for a better understanding of my invention, I show in FIG. 5 my improved device 10 for transmitting power from a power driving unit, such as a conventional electric drill 11, to a driven member of an internal combustion engine, such as the small internal combustion engine 12 of a lawnmower 13. The device 10 comprises a first shaft-like power transmitting member 14 in axial alignment with a second shaft-like power transmitting member 16. A reduced diameter end portion 17 is provided on the first shaft-like member 14 for detachably connecting it to the chuck 18 of the electric drill 11. An axially extending polygonal recess 19 is provided in one end portion of the second shaft-like member 16 for detachably connecting it to the outer end portion 21 of the drive shaft for the engine. While I have shown the drivingunit as being an electric drill, it will be apparent from the description hereinafter disclosed that other power driving units may be employed, such as hydraulic or air-driven units.

Figure 2:
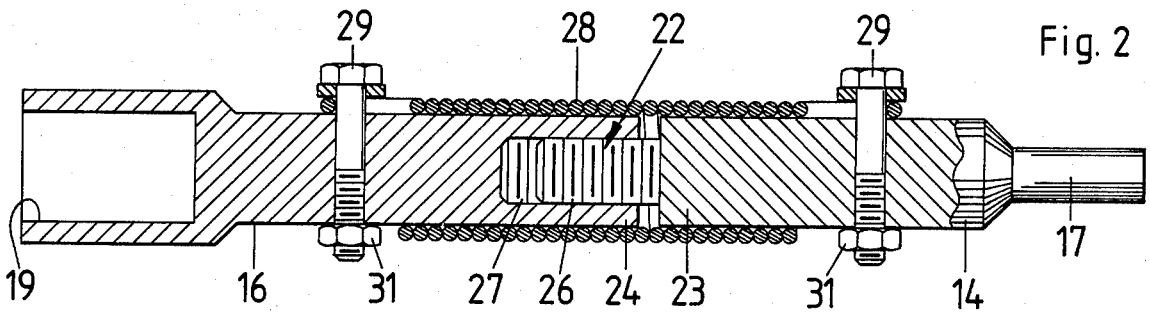
FIG. 2 is a view corresponding to FIG. 1, partly in section, showing the threaded connection between adjacent end portions of the shaft-like power transmitting members.
Figure 3:
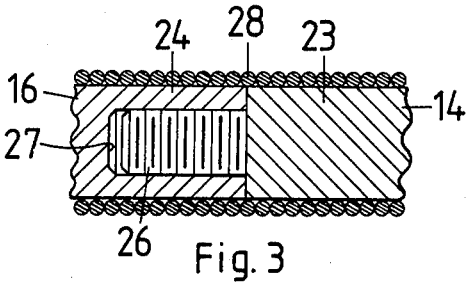
FIG. 3 is a fragmental sectional view corresponding to FIG. 2, showing the adjacent end portions of the power transmitting members engaging each other.

A threaded connection, indicated generally at 22, is provided between adjacent axially aligned end portions 23 and 24 of the shaft-like members 14 and 16, respectively, as shown in FIGS. 2 and 3. The threaded connection 22 comprises cooperating male and female members 26 and 27, respectively, which are carried by the adjacent end portions 23 and 24, respectively, and which are adapted to threadedly engage each other, as shown. Upon relative rotation of the male and female members 26 and 27 in one direction, the end portions 23 and 24 move axially toward each other and then abutt each other. Upon relative rotation of the male and female members 26 and 27 in the opposite direction, the end portions 23 and 24 move away from each other, as shown in FIG. 2. The male member 26 is in the form of a reduced diameter externally threaded portion provided on the end portion 23 and defines a shoulder 27 which is adapted to engage the adjacent end of end portion 24 and thus transfer power from the electric drill 11 to the engine 12. While I have shown the male member 26 carried by the end portion 23 and the female member 27 carried by the end portion 24, it will be apparent that their positions may be reversed.

Figure 1:
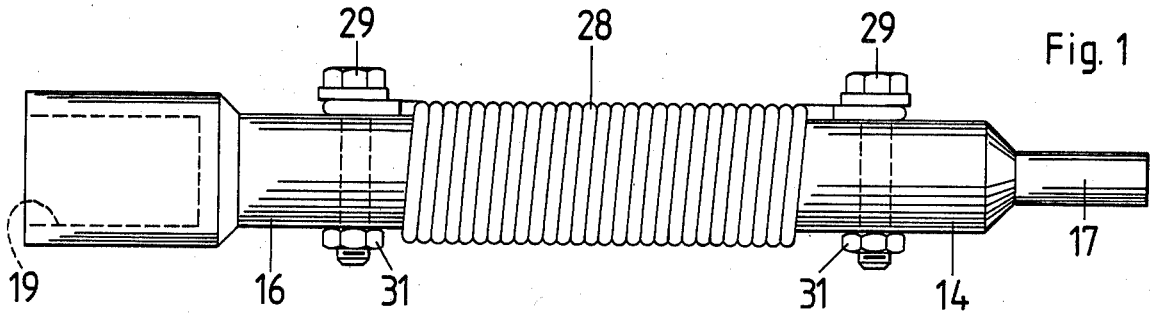
FIG. 1 is a side elevational view of my improved device for transmitting power from a power driving unit to a driven member of an internal combustion engine.
Figure 4:
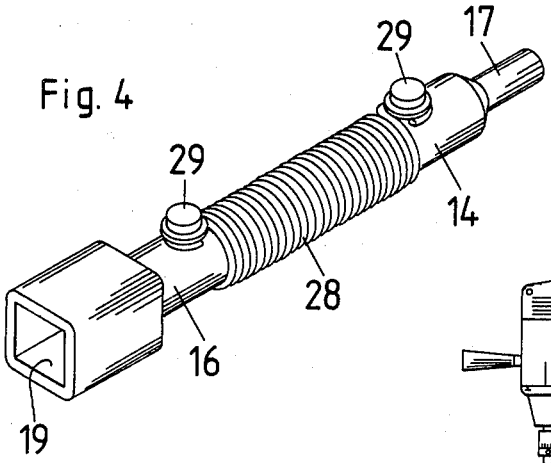
FIG. 4 is a perspective view of the power transmitting device shown in FIG. 1; and, FIG. 5 is a view showing my improved device assembled between a power driving unit and a driven member of a gasoline engine carried by a conventional lawnmower.

A resilient member, such as a coiled torsion spring 28, surrounds and operatively connects the first shaft-like member 14 to the second shaft-like member 16 in a manner to absorb any shock or kick-back forces generated by the engine 12. That is, as the end portions 23 and 24 move toward each other, a torsional compressive force is applied to the spring 28. When the end portions 23 and 24 contact each other, power is transmitted to the drive shaft of the engine 12. In the event the engine 12 fires but does not start, the torsional force of spring 28 will absorb any shock or kick-back forces transmitted from the engine 12. In other words, when the engine 12 fires, its drive shaft will be rotating faster than the drill 11. This results in a shock load being transmitted from the engine 12 which is absorbed by the spring 28. When the drive shaft slows down, a kick-back force is created which is also absorbed by the spring 28. The spring 28 is detachably connected to the shaft-like members 14 and 16 by suitable bolts 29 and nuts 31, as shown in FIGS. 1, 2 and 4.

From the foregoing description, the operation of my improved device for transmitting power from a power driving unit to a driven member of an internal combustion engine will be readily understood. With the device 10 assembled as shown in FIG. 2, the reduced diameter end portion 17 is connected to the chuck 18 of the drill 11. The polygonal recess 19 provided at one end of the second shaft-like member 16 is detachably connected to the outer end portion 21 of the drive shaft of the engine 12. After the drill is started, the compression of the engine permits the adjacent end portions 23 and 24 of the power transmitting members 14 and 16, respectively, to move toward and then engage each other, as shown in FIG. 3. Power from the drill 11 is thus transmitted to the outer end portion 21 of the drive shaft for the engine 12. As the engine 12 fires, it will rotate faster than the drill 11 and the shock load created by the sudden increase in speed will be absorbed by the spring 28. If the engine 12 does not start, a kick-back force will be created as the engine slows down. This kick-back force will also be absorbed by the spring 28. After the engine starts, the device is removed from the outer end portion 21 of the drive shaft whereby the device 10 is easily removed from the engine 12.

From the foregoing, it will be seen that I have devised an improved device for transmitting power from a power driving unit to a driven member of an internal combustion engine which is simple of constructon and economical of manufacture. Also, my improved device enables a person who is physically impaired to quickly and easily start a small internal combustion engine, such as the engine for a conventional lawnmower or the like. Furthermore, my improved device absorbs any shock or kick-back forces generated by the internal combustion engine which would damage the power driving unit.

While I have shown my invention in but one form, it will be obvious to those skilled in the art that it is not so limited, but is susceptible of various changes and modifications without departing from the spirit thereof.

What I claim is:

1. A device for transmitting power from a power driving unit to a driven member of an internal combustion engine comprising:

(a) a first shaft-like power transmitting member having one end adapted to be detachably connected to said power driving unit, (b) a second shaft-like power transmitting member in axial alignment with said first shaft-like power transmitting member with one end thereof adapted to be detachably connected to said driven member with the other ends of said first and second power transmitting members defining adjacent end portions, (c) a reduced diameter externally threaded end portion on one of said adjacent end portions in threaded engagement with a threaded opening in the other of said adjacent end portions and defining a shoulder in position to move toward and abut the end of said other of said adjacent end portions and transfer power from said driving unit to said driven member in response to relative rotation of said adjacent end portions in one direction and to move away from the end of said other of said adjacent end portions in response to relative rotation of said adjacent end portions in the opposite direction, and (d) resilient means operatively connecting said first and said second power transmitting members to each other to define a shock absorber between said power driving unit and said driven member.

* * * * *